United States Patent [19]

Yamazaki et al.

[11] 4,185,074

[45] Jan. 22, 1980

[54] CATALYTIC CONVERTER WITH A CATALYST BED SUPPORTER

[75] Inventors: Takayuki Yamazaki, Tokyo; Takahisa Izumi, Fujisawa; Hajime Kawasaki, Yokohama, all of Japan

[73] Assignee: Nissan Motor Company, Limited, Yokohama, Japan

[21] Appl. No.: 783,779

[22] Filed: Apr. 1, 1977

[30] Foreign Application Priority Data

Apr. 2, 1976 [JP] Japan ..... 51-41334[U]

[51] Int. Cl.[2] ..... B01J 8/02; F01N 3/15

[52] U.S. Cl. ..... 422/177; 60/299; 60/301; 422/179

[58] Field of Search ..... 23/288 F; 60/299, 301; 248/248, 250; 211/41; 55/DIG. 30; 422/168, 170, 171, 176, 177, 179

[56] References Cited

U.S. PATENT DOCUMENTS

| | | | |
|---|---|---|---|
| 2,776,875 | 1/1957 | Howdry | 23/288 F |
| 3,801,287 | 4/1974 | Scheitlin et al. | 23/288 F |
| 3,809,539 | 5/1974 | Balluff | 23/288 F |
| 3,927,984 | 12/1975 | Hartley | 23/288 F |

*Primary Examiner*—Michael S. Marcus

*Attorney, Agent, or Firm*—Schwartz, Jeffery, Schwaab, Mack, Blumenthal & Koch

[57] ABSTRACT

A catalyst bed supporter is disposed in a container of a catalytic converter so that it abuts the catalyst bed only when the catalyst bed is subjected to heat expansion. Thus, the catalyst bed is prevented from being excessively expanded even when heated.

8 Claims, 3 Drawing Figures

CATALYTIC CONVERTER WITH A CATALYST BED SUPPORTER

FIELD OF THE INVENTION

The present invention relates in general to a catalytic converter for catalytically treating the exhaust gases emitted from combustion means and more particularly to a catalytic converter having therein a so-called catalyst bed in which a plurality of catalyst pellets are contained or packed.

BACKGROUND OF THE INVENTION

It is sometimes observed in conventional catalytic converters that the catalyst bed is subjected to a sagging phenomenon especially of a portion thereof remote from a portion which is directly connected to some rigid member of the converter. This is because the exothermic reaction of the catalyst pellets gives off a great amount of heat which causes the bed to be heated at a high temperature ranging from about 700° C. to 900° C., so that the bed is subjected to considerable volume expansion. Furthermore, under such high temperatures, the bed is curved or bent downwardly at the unsupported portions thereof because of weight of the catalyst therein. This phenomenon becomes more critical when the catalyst bed is formed with outwardly projecting louvers.

In the case that the catalyst bed is expanded, the catalyst pellets in the bed can become loose thus causing the mutual abrasion of same to produce ultrafine catalyst powder which will cause the so-called secondary air-pollution problem. Furthermore in this case, the flow resistance of the converter is increased because the downstream passage of the converter is critically limited by the sagging of the expanded catalyst bed.

Although stud bolts for firmly connecting the catalyst bed to the container of the converter can be used, the flow resistance of the converter is considerably increased by the provision of same, acting in this instance as flow restrictors.

SUMMARY OF THE INVENTION

Therefore, the present invention proposes to eliminate these drawbacks encountered in the conventional catalytic converter mentioned above.

It is an object of the present invention to provide an improved catalytic converter which has therein means for preventing a catalyst bed from sagging and/or overly expanding even when the bed is excessively heated.

It is another object of the present invention to provide an improved catalytic converter which has therein a catalyst bed and a bed supporting device which abuts the catalyst bed only when the catalyst bed is subjected to heat expansion.

According to the present invention, there is provided a catalytic converter for catalytically treating the exhaust gases emitted from combustion means, the converter comprising: a container having at one end thereof exhaust gas inlet means and at the other end thereof exhaust gas outlet means, the inlet means being adapted to fluidly connect with the combustion means; a catalyst bed disposed in the container to define a chamber between and outer surface of the bed and an inner surface of the container so that the exhaust gases from the inlet means pass through the bed and the chamber before reaching the outlet means, the bed being expanded toward the chamber when heated; and a bed supporting device stationarily disposed in the chamber for supporting the catalyst bed only when the bed is expanded at a predetermined degree due to heat application, whereby the catalyst bed is prevented from excessively thermal expansion when the catalyst bed is excessively heated.

SUMMARY OF THE DRAWINGS

Other objects and advantages of the present invention will become more clearly understood from the following detailed description when taken in conjunction with the accompanying drawings, in which.

DESCRIPTION OF THE PREFERRED EMBODIMENT

Figure 1:
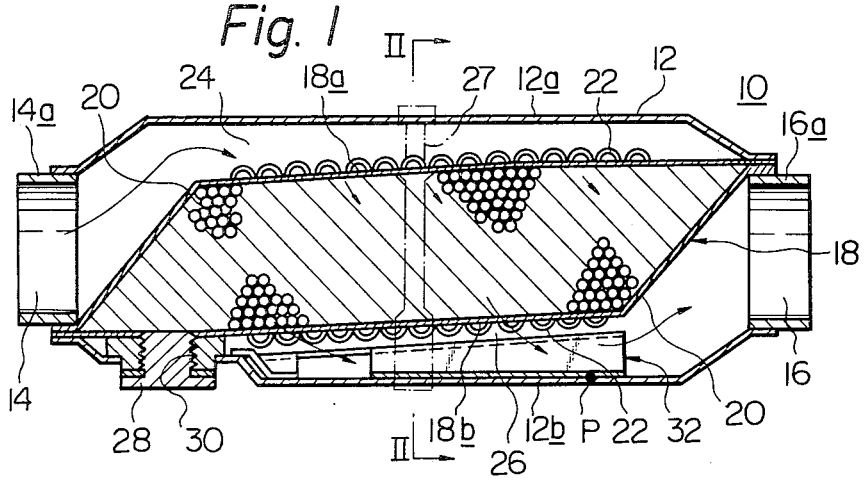
FIG. 1 is a sectional view of an improved catalytic converter according to the present invention.
Figure 2:
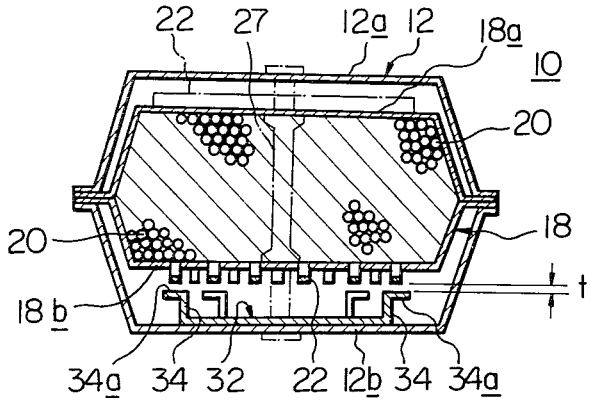
FIG. 2 is a sectional view taken along the line II—II of FIG. 1.

Referring to FIGS. 1 and 2, particularly to FIG. 1, there is illustrated an improved catalytic converter of the invention, which is generally designated by the reference numeral 10. The converter 10 is operatively disposed in an exhaust conduit system of a combustion means such as internal combustion engine (not shown) and generally comprises a container 12 having a generally hexagonal cross section as seen in FIG. 2. The container 12 consists of an upper shell member **12*a* and a lower shell member 12*b* which are firmly connected at their ridge or flanged edge portions to form a chamber therebetween. The container 12 has an exhaust gas inlet opening 14 at its upstream portion and an exhaust gas outlet opening 16 at its downstream portion. Designated by the numerals 14*a* and 16*a* are respective tubes which are disposed in the inlet and outlet openings 14 and 16. Within the container 12 is disposed an inclined catalyst bed 18 which has packed therein catalyst pellets 20. As well shown in FIG. 2, the catalyst bed 18 has a generally hexagonal cross section and consists of upper and lower vessels 18*a* and 18*b* which are formed with a plurality of louvers 22 extending outwardly away from the corresponding vessels. The louvers 22 contribute substantially to the fluid communication between the interior and the exterior of the bed 18. The catalyst bed 18 is supported or arranged in the container 12 so as to define upper and lower chambers 24 and 26 in the container 12 which are respectively located between the inlet opening 14 and the upper vessel 18*a* and between the lower vessel 18*b* and the outlet opening 16. As shown, mounting of the bed 18 in the container 12 is achieved by fixing the ridge portions (no numerals) of the bed 18 to the ridge portions (not numerals) of the container 12 and employing a few stud bolts 27 (though only one stud bolt is illustrated) passed through the container 12 and the catalyst bed 18. The catalyst bed 18 is inclined longitudinally with respect to the container 12 thus allowing each of the upper and lower chambers 24 and 26 to have a generally wedge shape. Designated by the numeral 28 is a plug which is releasably fixed to an opening 30 of the catalyst bed 18, the opening 30 being used for changing the catalyst pellets 20**.

Now, according to the present invention, the converter 10 has further a so-called catalyst bed supporting device which is generally designated by the numeral 32.

The device 32 is so constructed as to abut the catalyst bed for supporting the bed only when the bed 18 is subjected to heat expansion, thus preventing the catalyst bed 18 from undergoing excessive expansion even when the bed is excessively heated during the operation of the converter 10. This means that the unwanted phenomenon in which the catalyst pellets 20 becomes loose in the bed 18 by the expansion of the bed 18 can be eliminated.

Figure 3:
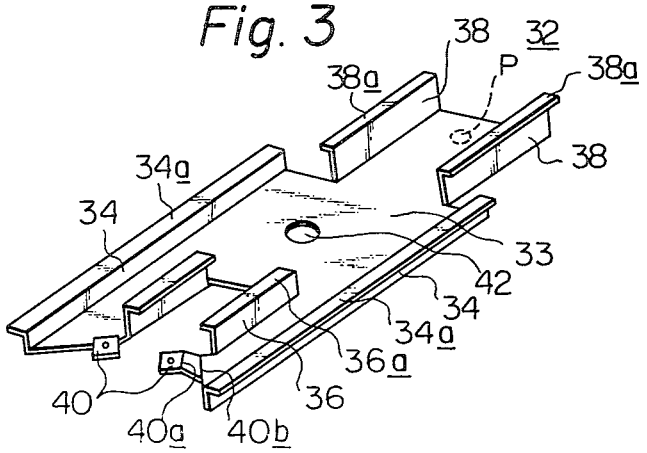
FIG. 3 is a perspective view of a catalyst bed supporting device employed in the converter of the invention.

In FIG. 3, there is shown an example of the supporting device 32, which is made of some heat resisting material such as stainless steel through metal processing and comprises an elongated channel plate member having a base portion 33 and at its lateral sides upwardly extending flange portions 34. The free ends of the flange portions 34 are bent substantially normal thereto to form platform portions 34*a*. Preferably, additional flange portions 36 and 38 with platform portions 36*a* and 38*a* are formed to the supporting device, as shown, in addition to the above-mentioned flange portions 34 for improving the supporting function of the device 32. As well shown in this Figure, a pair of lug portions 40 is provided or formed to one longitudinal end of the member 32. Each lug portion 40 is bent into two sections 40*a* and 40*b* for the reason as will be described hereinafter.

As well shown in FIG. 1, the bed supporting device 32 is located in the second chamber 26 of the container 12 in such an arrangement that the flange portions 34, 36 and 38 are substantially parallel to the longitudinal axis of the converter or the direction of the movement of the exhaust gases being passed through the second chamber 26. The device 32 is tightly connected at a portion designated by "p" and the pair of the lug portions 40 to the lower shell member 12*b* by a conventional fastening technique such as welding and/or bolt fastening. In this embodiment, the lug portions 40 are connected to a portion near the opening 30. From the foregoing, it will be appreciated that the lug portions 40 are gradually flexed via the bent portions 40*a* and 40*b* as the device 32 is subjected to heat expansion. This means that the heat expansion of the device 32 is substantially absorbed by the flexing or bending of the lug portions 40. As well seen from FIG. 2, each of the platform portions 34*a*, 36*a* and 38*a* is illustrated to be spaced from the outer or lower surface of the lower vessel 18*b* at a predetermined distance (t). Preferably, the distance (t) is determined to range from about 0.5 m/m to about 1.0 m/m at ambient temperature (about 20° C. to 30° C.). For keeping the distance at the predetermined degree throughout the entire length thereof, each of the portions 34, 36 and 38 are formed inclined relative to the base 33 as well seen from FIG. 1. The reason why such distance (t) must be prepared is as follows: First, there is a tendency that if the platform portions 34*a*, 36*a* and 38*a* are firmly abutted against the lower vessel 18*b*, the catalyst bed 18 may be subjected to an extremely large compression force when heated, the force being produced by the upward expansion of the flange portions 34, 36 and 38 of the device 32. This phenomenon may cause the destruction of the catalyst bed 18. Second, there is a tendency for the connection between the platform portions 34*a*, 36*a* and 38*a* and the lower vessel 18*b* to close some of the louvers 22. In this case, the flow resistance of the converter 10 would be considerably increased.

Indicated by the numeral 42 is an opening through which the before-mentioned stud bolt 27 is passed. Usually, the diameter of the opening 42 is larger than that of the stud bolt 27 so that the expansion of the supporting device 32 will not affect the stud bolt 27. However, this consideration is not needed if another pair of bent lug portions are provided to the other longitudinal end of the channel plate member.

From the above-stated construction of the converter 10 of the present invention, the operation is as follows.

During the operation of the combustion means, the exhaust gases containing therein harmful compounds such as HC and CO are fed into the catalytic converter 10 for the catalytic treatment of same. During this process, the catalytic bed 18 is heated mainly by heat given off by exothermic reaction of the operating catalyst pellets 20. Thus, the catalytic bed 18 is inevitably expanded. However, when the catalyst bed 18 is expanded to a degree in which the lower surface of the bed 18 abuts the platform portions 34*a*, 36*a* and 38*a*, the expansion of the bed 18, more particularly the expansion toward the second chamber 26 is stopped. Under such a condition, the catalyst bed 18 maintains its originally set pellet holding capacity even when further heated. Thus, the catalyst pellets 20 in the bed 18 are prevented from becoming loose.

In the present invention, the following several constructional features are provided, which are:

(1) Since the flange portions 34, 36 and 38 are arranged substantially parallel to the direction of the movement of the exhaust gases passed through the lower chamber 26, the provision of the flange portions does not obstruct the smooth passage of the exhaust gases. This means that the flow resistance of the converter 10 is not critically increased.

(2) Since the bed supporting device 32 is formed to have a so-called heat expansion absorbing means (such as the lug portions 40), the thermal stress generated in the device 32 is remarkably decreased.

(3) Since the bed supporting device 32 can be made of stainless steel plate through a metal stamping process, the production cost of the device 32 is quite low.

Although in the previous description, the bed supporting device has been described located in the lower chamber 26 in the container 12, it is also possible to arrange such device in the upper chamber 24 in generally the same manner as described hereinbefore.

What is claimed is:

1. A catalytic converter for catalytically treating the exhaust gases emitted from an engine, comprising:

a. a container having at one end thereof an exhaust gas inlet opening and at the other end thereof a treated gas outlet opening;

b. a catalyst bed disposed in said container to define in said container first and second chambers which are respectively located between said inlet opening and said catalyst bed and between said outlet opening and said catalyst bed so that the exhaust gas fed through said inlet openings passes through said first chamber, the interior of said catalyst bed and said second chamber before discharging through said outlet opening; and c. a bed supporting device disposed in said second chamber for supporting said catalyst bed only when said catalyst bed is subjected to expansion causing a portion thereof to extend toward said bed supporting device, said bed supporting device comprising an elongated flat main portion with first and second longitudinal ends, said flat main portion being directly secured to said container at a limited portion thereof adjacent said first end, a plurality of elongated spaced flange portions which perpendicularly project from said flat main portion toward said catalyst bed so as to be engageable with said catalyst bed to support the same when said bed is subjected to expansion, said flange portions being arranged parallel to the flow direction of the treated gases passing through said second chamber, and each of said flange portions comprising at its free end a bent platform portion which is engageable with said catalyst bed upon expansion of said catalyst bed, and at least one lug portion which integrally and flexibly extends from said longitudinal end toward said catalyst bed and is secured at the leading ends thereof to an inwardly raised portion of said container, said lug portion being inclined with respect to the plane substantially defined by said flat main portion, whereby longitudinal expansion of said bed supporting device due to heat is substantially absorbed by flexing of the inclined lug portion.

2. The catalytic converter as claimed in claim 1, wherein the plane of said platform is parallel to the plane of said elongated flat main portion of said bed supporting device.

3. The catalytic converter as claimed in claim 1, wherein said elongated flat main portion of said bed supporting device comprises at its generally middle portion an opening through which a stud passing through said container is loosely passed.

4. The catalytic converter as claimed in claim 1, wherein the height of said elongated flange is gradually changed throughout the entire longitudinal length thereof so as to accommodate with the configuration of said second chamber.

5. The catalytic converter as claimed in claim 1, wherein said lug portion extends toward said catalyst bed.

6. The catalytic converter as claimed in claim 1, comprising two said lug portions in spaced relationship.

7. The catalytic converter as claimed in claim 1, wherein said bed supporting device is arranged so that the longitudinal axis thereof is parallel to the flow direction of the treated gases passing through said second chamber.

8. The catalytic converter as claimed in claim 7, wherein said first and second ends of said elongated flat main portion are located near said outlet opening and said inlet opening, respectively.

* * * * *